United States Patent [19]

Marcanio

[11] Patent Number: 4,485,502

[45] Date of Patent: Dec. 4, 1984

[54] PORTABLE BATHING TUB FOR INVALIDS

[76] Inventor: Louis Marcanio, 96 Queens Lane, Rochester, N.Y. 14617

[21] Appl. No.: 420,279

[22] Filed: Sep. 20, 1982

[51] Int. Cl.[3] ..... A47K 3/06

[52] U.S. Cl. ..... 4/585; 4/587

[58] Field of Search ..... 4/585, 651, 509, 498–507

[56] References Cited

U.S. PATENT DOCUMENTS

| | | | |
|---|---|---|---|
| 1,051,393 | 1/1913 | Dunlap | 4/651 |
| 2,483,789 | 10/1949 | Smith et al. | 4/585 X |
| 3,112,498 | 12/1963 | Hoffman | 4/585 |
| 3,246,346 | 4/1966 | Schmidt | 4/585 X |
| 3,334,360 | 8/1967 | Hoxeng et al. | 4/585 |
| 3,373,451 | 3/1968 | Schmidt | 4/585 |
| 3,557,392 | 1/1971 | Schmidt | 4/585 X |
| 4,034,424 | 7/1977 | Budlong | 4/585 X |
| 4,115,878 | 9/1978 | Johnson et al. | 4/509 X |

*Primary Examiner*—Henry K. Artis

*Attorney, Agent, or Firm*—Stonebraker, Shepard & Stephens

[57] ABSTRACT

A portable bathing tub for invalids, especially bed-ridden persons. There is a large waterproof sheet which is laid on one half of the width of the bed, while the person rolls to the other half. Then the person rolls onto the half where the sheet has been placed, and the remainder of the sheet is extended over the second half of the bed, and the margins are gathered up close to or onto the person when the person is approximately centered on the bed. A frame of four L-shaped members, preferably made of plastic material, is erected to form a rectangular enclosure of low walls around the person. The edges of the waterproof sheet are then placed against these low walls and extend up the inside surfaces of the walls and are folded over the top edges of the walls, held there by spring clips. Water is then added to this shallow tub, so the person may bathe or be bathed. An outlet conduit allows the water to be drained when the bath is completed. A by-pass around a valve in the outlet conduit rises to an elevation slightly below the top edge of the tub walls, so as to retain water (up to this elevation) when the valve is closed, but to allow excess water to pass out through the by-pass if the tub is accidentally filled too close to the top edge of the tub walls. The L-shaped members are easily disassembled for storage between baths.

5 Claims, 6 Drawing Figures

PORTABLE BATHING TUB FOR INVALIDS

BACKGROUND OF THE INVENTION

The invention relates to a portable tub to enable bedridden persons or other invalids to bathe or be bathed. It is intended especially for home use by the family of the afflicted person, but it may be used also in hospitals, nursing homes, or other institutions.

SUMMARY OF THE INVENTION

The invention provides a portable tub erected around a person lying on a bed or other appropriate approximately level surface. The person rolls to one side, just as would normally be done when changing a bottom sheet of the bed, and a large waterproof plastic sheet is placed on the exposed part of the bed. The person then rolls onto the plastic sheet, which is then smoothed out onto the rest of the width of the bed. The edges of the waterproof sheet and then temporarily folded up over the person, and a portable rigid frame is erected around the person, and then the marginal edges of the plastic sheet are smoothed out over the area within the frame and extended up the walls of the frame and folded over the top edges of the frame, and are held in place by spring clips applied to the plastic sheet at the top edges of the frame. A drainage hose with a shut-off valve and a safety overflow connection is assembled, and the tub is ready to have water supplied to it, either through a supply hose, or by means of buckets, or in any convenient way. The patient may bathe, or be bathed by someone else, after which the water is drained out, and the tub is disassembled and stored until it is needed again.

An object of the invention is the provision of an improved inexpensive and simple tub which may be easily and quickly assembled around a person who is able to roll from side to side on a bed but is unable to leave the bed, and which can be easily and quickly disassembled and stored after each use.

BRIEF DESCRIPTION OF THE DRAWINGS

In the accompanying drawings, which illustrate a preferred embodiment of the invention by way of example.

DESCRIPTION OF A PREFERRED EMBODIMENT

Figure 1:
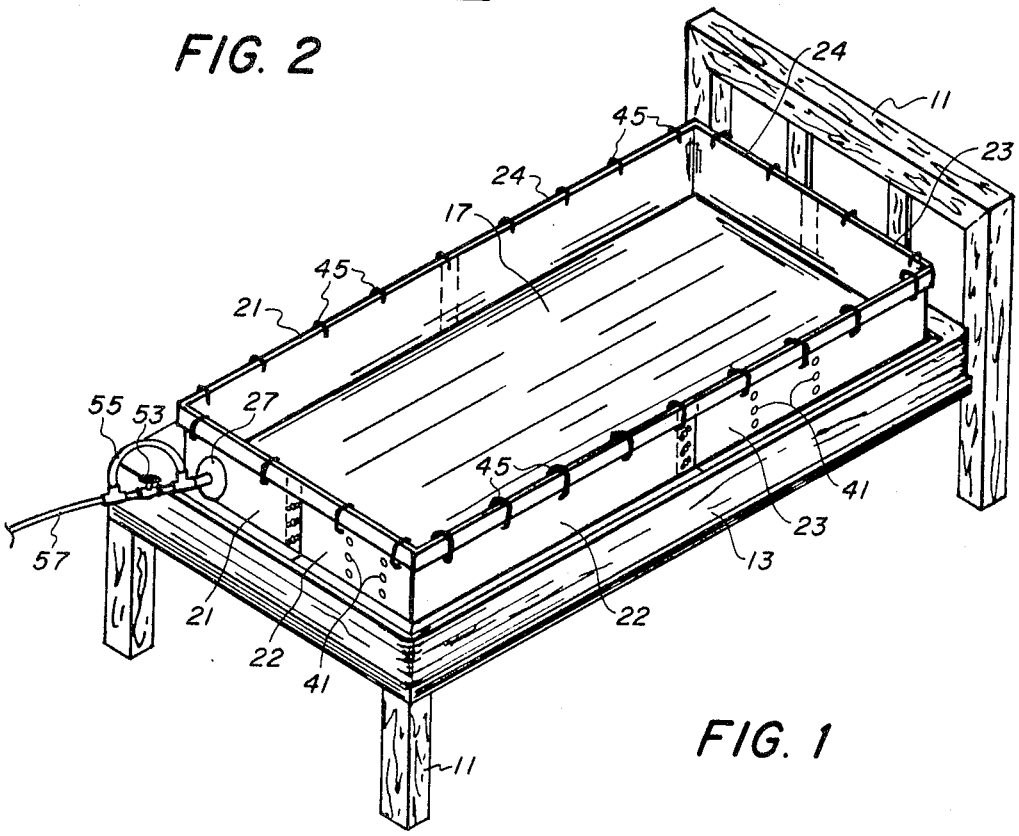
FIG. 1 is a perspective view of the assembled tub on a bed.

Referring first to FIG. 1, there is shown a bed frame or bedstead 11 of any conventional known kind, the details of which are not important for purposes of the present invention. It supports a mattress 13, likewise of any conventional known form, the details of which are unimportant.

The tub of the present invention is shown in its completely assembled condition, ready for use. It comprises a large plastic waterproof sheet 17 having upturned marginal edges held in place by an upstanding rigid frame made up of four separate frame members each small enough to be easily handled and conveniently stored when not in use, the frame members being overlapped and detachably secured to each other when the tub is assembled for use.

Figure 6:
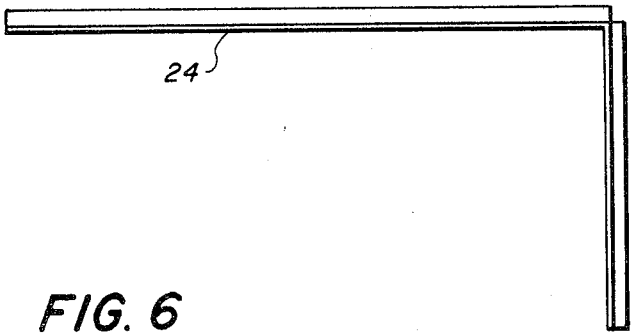
FIG. 6 is a plan view of a "right-hand" frame member.

Each of these four frame members is L-shaped in horizontal plan, and the four fit together to make a rectangular enclosure as seen in FIG. 1, with the angle of each "L" at one corner. They are respectively designated in FIG. 1 at 21, 22, 23, and 24. The frame members 21 and 23, at diagonally opposite corners of the structure, are called left-hand frame members, and the members 22 and 24 at the other two diagonally opposite corners are called right-hand frame members. Each has a longer leg and a shorter leg. The difference is that in the left-hand members, the short leg (e.g., **21*a* of the member 21) when viewed as in FIG. 4 is at the left hand end of the longer leg 21*b*, whereas in the right-hand frame members (see member 24 in FIG. 6**) the short leg is at the right-hand end of the long leg.

Figure 3:
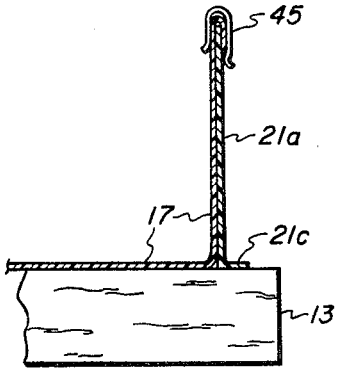
FIG. 3 is a fragmentary vertical section taken transversely through a side frame member with the plastic sheet and holding clip in place thereon.

Otherwise the four frame members are the same in size and material. They are preferably made of a fairly stiff or rigid plastic material. The vertical web or plate portion is approximately 14¾ or 15 inches high, which is found in practice to be convenient, but it may be made higher, if a deeper tub holding a deeper bath of water is desired. At the bottom of this vertical web, and formed integrally therewith, is an outturned marginal flange, designated **21*c* in FIGS. 3 and 4, with respect to the first frame member 21**, and not separately identified on the other frame members. This flange is preferably about 1¼ inches wide, and helps to resist outward bulging of the frame members from pressure of water in the tub.

Figure 4:
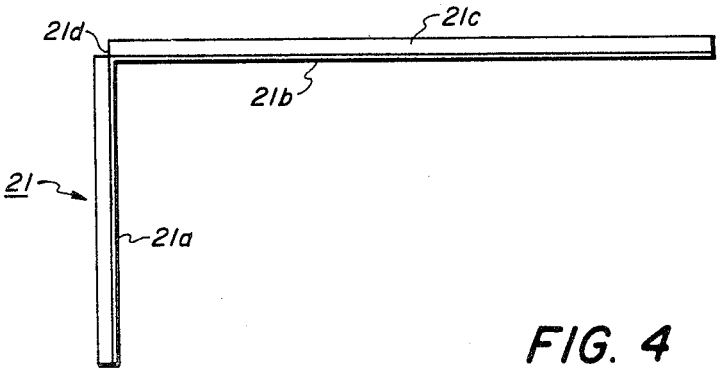
FIG. 4 is a plan view of a "left-hand" frame member.

This bottom flange **21*c* is notched at the corner of the frame member, as shows at 21*d* in FIG. 4**, so as to allow the short leg and the long leg of the frame member to be bent at a right angle to each other, though originally formed from a single straight piece of the plastic material.

Conveniently and preferably, the long leg of each L-shaped frame member is 48 inches long, and the short leg is 24 inches long. If the frame members are assembled with a four inch overlap of each leg of one member onto the adjacent leg of the next frame member, these dimensions will provide a tub 92 inches long and 44 inches wide, entirely adequate for comfortable bathing movements of even a quite large person. By erecting the frame members with greater overlap of the respective legs, a tub of any desired smaller size may be provided, thus saving water, which may be important when only a limited supply of warm or hot water is available.

Figure 5:
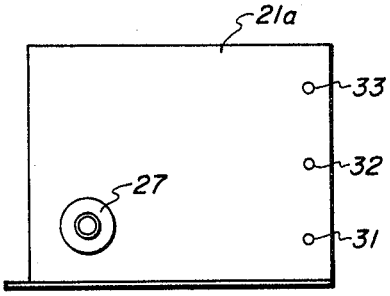
FIG. 5 is an end elevation thereof.

One of the short legs of the frame at the foot of the bed (e.g., the leg portion **21*a* of the frame member 21) is provided with an opening through which a drainage conduit may extend. This opening is shown at 27 in FIGS. 1 and 5**, and is preferably a circular opening about 4 inches in diameter, with its center about 1½ inches above the bottom of the frame member. The drainage connection associated with this opening will be further described below.

The vertical webs of the frame members have bolt holes for receiving bolts for detachably holding the frame members in the desired overlapping relationship. Preferably there are two or three bolt holes arranged vertically one above another near the ends of the respective legs of the frame members, and so placed that when the frame members are assembled in the desired position, the holes in adjacent members will line up with each other so that bolts may be inserted. Bolt holes near the end of the short leg 21*a* of the frame member 21 are shown at 31, 32, and 33 in FIG. 5, and there are similar bolt holes near the ends of all of the legs of all of the frame members. Bolt holes near the ends of the legs will suffice if the frame is always to be erected at its maximum size. But as explained above, it may be desired to overlap the frame members to a greater extent, to provide a tub of smaller size, and therefore one leg of each frame member is provided with a series of sets of bolt holes, at different positions along the length of the leg, as indicated at 41 in FIG. 1. The bolt holes in the adjacent leg of the next frame member may be brought into registry with any desired set of bolt holes in the leg provided with several sets, so as to erect the frame to the desired size.

The bolts used in assembling the structure preferably have smooth rounded heads, placed on the inside of the frame, so they do not chafe and cause leaks in the waterproof plastic sheet. The threaded shank of the bolt extends outwardly through the two aligned holes in the two thicknesses of overlapped frame members, and is held by a suitable nut applied on the outside, preferably a wing nut which can be quickly screwed onto the bolt or removed therefrom by hand, without requiring any tools.

After the frame is assembled, the waterproof sheet 17 is unfolded from its temporary position lying partially on or close to the sides of the person lying in the tub, and the sheet is spread flat over the area of the bed within the erected frame, and the marginal edges of the sheet are extended up the inner walls of the frame members and folded over the top edges of the frame members. A series of spring clips of hairpin-like shape are applied over the top edges at appropriate intervals, as seen at 45 in FIGS. 1 and 3, to hold the plastic waterproof sheet in place. The clips are preferably of rubber-coated spring metal.

Figure 2:
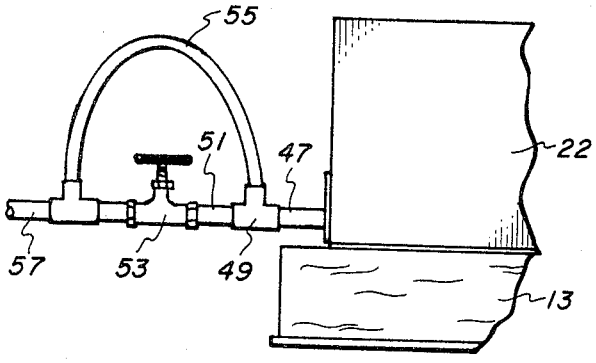
FIG. 2 is a fragmentary side elevation illustrating a preferred form of drainage connection with shut-off valve and safety overflow.

The waterproof sheet 17 has a drainage connection sealed to it in watertight manner, this connection comprising a short discharge conduit or nipple 47 (FIG. 2) which is positioned to extend out through the above mentioned hole 27 in the frame member at the foot of the bed. A quick-attachable hose fitting 49 of any conventional known kind is attached to the protruding end of the drain conduit 47. This fitting 49 connects witth a drainage conduit section 51 containing a valve 53, around which is an arched by-pass conduit 55 arching upward to a height a little below the elevation of the top edge of the frame members 21, 22, etc. Beyond the by-pass 55, a further drainage conduit, such as a flexible hose 57, of any desired length leads to any desired discharge point at a lower elevation, such as a conventional toilet bowl, or a bathtub.

The manner of assembling and using this portable tub will be apparent from the foregoing description. When assembly has been completed and the valve is closed, water is introduced into the tub in any convenient way, by carrying pails of water if necessary, or preferably by means of a hose from the faucet of a bathtub, sink, or washbasin. If an attendant is called away to answer a telephone or door bell while water is being introduced through a hose, any danger of filling the tub too full and spilling water out over the top edge is eliminated by the safety by-pass 55, because water will flow out through this by-pass and to the drain, even though the drain valve 53 is closed.

When the required amount of water has been put in the tub, the invalid person bathes or is bathed by an attendant. When bathing is completed, the valve 53 is opened and the water is drained out. Any small residue of water that does not drain out may be removed by using large sponges. Then the drainage system is disconnected at the fitting 49, the spring clips 45 are removed so that the plastic waterproof sheet 17 may be taken off the walls of the frame, the bolts are taken out, and the four L-shaped frame members are dis-assembled and stored until needed for the next bath of the invalid. The plastic sheet is removed from the bed, rolling the person first to one side and then to the other, just as when changing an ordinary sheet on a bed, and this completes the cycle of use of the tub of the present invention.

It has been said above that the L-shaped frame members are made of plastic material. Various kinds of plastic material may be used, so long as it is sufficiently stiff to withstand the water pressure without detrimental bulging, when the tub is filled. Some commercially available kinds of plastic material will form webs or walls sufficiently stiff, yet will flex and act like a hinge at the corners where the two legs of the respective frame members join each other. When made of such material, the L-shaped members may be straightened out into a straight-line position for storage, and may be bent again to L-shape when assembled for use. When a plastic material which is stiffer or more rigid is used, the members can be left always in the L shape, and be stored in this shape. It is also possible to make the frame members of sheet metal rather than plastic material, or even of plywood strips held together at the corners by angle braces, but plastic material is preferred because it is lighter and more easily handled, and there is no danger of rust which might occur in a metal construction, or of slivers which might come from plywood.

To aid in quick assembly, the frame members may be color coded, with the same color on the two legs of the two frame members which overlap each other at the foot of the bed, a different color on the parts which overlap each other on one side of the bed, a still different color on the parts which overlap at the head of the bed, and so on. Then even a novice who is assembling the structure for the first time should have no trouble in seeing exactly how the frame parts fit together.

This construction is very simple, quite inexpensive, and should be a welcome addition to any home containing a bedridden member of the family.

What is claimed is:

1. Bathing equipment for use especially by a bedridden person situated on a flat surface, said equipment comprising a large waterproof sheet of sufficient size so that part of the sheet may be placed on part of the surface area of a bed or the like when a person rolls to another part of the area and another part of the sheet may then be extended over a further surface area of the bed when the person rolls onto the previously placed part of the sheet, four portable frame members each L-shaped in plan and arranged for easy assembly and dis-assembly on the bed to form, when assembled, a rectangular enclosure of low upright walls surrounding the person on the waterproof sheet and arranged with one leg of each L-shaped member extending along one side of said said enclosure and the other leg of each L-shaped member extending along part of one end of said enclosure and with each leg of each member overlapping one leg of an adjacent member, detachable means for securing the legs of different members to each other where they overlap, said upright walls when assembled being substantially continuous and unbroken throughout their height, said sheet being of such size that the marginal portions thereof may extend up the inner surfaces of said walls to the top edges thereof, and means for holding said sheet in position on said walls to form a shallow tub to hold water for bathing the person resting on the sheet within said walls.

2. The invention defined in claim 1, wherein each leg of said L-shaped members has an outwardly extending flange running along the length of the leg substantially at the bottom thereof, to strengthen the leg against outward bulging as a result of pressure of water within the tub.

3. The invention defined in claim 1, wherein each of said L-shaped members is made of plastic material.

4. The invention defined in claim 1, wherein said sheet is folded over the top edges of said walls, and said holding means comprises means for holding said sheet in such position.

5. The invention defined in claim 4, wherein said holding means comprises a series of detachable spring clips of generally U-shape.

* * * * *